US006419450B1

(12) United States Patent
Lum

(10) Patent No.: US 6,419,450 B1
(45) Date of Patent: Jul. 16, 2002

(54) VARIABLE WIDTH PUMP IMPELLER

(75) Inventor: Ken Lum, Fresno, CA (US)

(73) Assignee: Grundfos Pumps Manufacturing Corporation, Fresno, CA (US)

( * ) Notice: Subject to any disclaimer, the term of this patent is extended or adjusted under 35 U.S.C. 154(b) by 0 days.

(21) Appl. No.: 09/861,442

(22) Filed: May 21, 2001

(51) Int. Cl.[7] ..... F04D 29/22
(52) U.S. Cl. ..... 416/186 A; 415/131
(58) Field of Search ..... 416/183, 185, 416/236 R, 237, 223 B; 415/131

(56) References Cited

U.S. PATENT DOCUMENTS

| | | | | | |
|---|---|---|---|---|---|
| 180,612 | A | * | 8/1876 | Marlin | 415/131 |
| 2,358,744 | A | | 9/1944 | Stepanoff | |
| 2,957,424 | A | * | 10/1960 | Brundage | 415/158 |
| 3,285,187 | A | | 11/1966 | Anderson | |
| 3,482,523 | A | * | 12/1969 | Morando | 415/140 |
| 3,918,831 | A | | 11/1975 | Grennan | |
| 4,070,132 | A | * | 1/1978 | Lynch | 415/131 |
| 4,412,783 | A | | 11/1983 | Barlass | |
| 4,417,849 | A | | 11/1983 | Morris | |
| 4,752,183 | A | * | 6/1988 | Sakurai | 415/131 |
| 4,828,454 | A | | 5/1989 | Morris et al. | |
| 5,211,530 | A | | 5/1993 | Shiffler | |
| 5,800,120 | A | * | 9/1998 | Ramsay | 415/131 |
| 6,074,167 | A | * | 6/2000 | Olifirov et al. | 415/131 |

* cited by examiner

*Primary Examiner*—F. Daniel Lopez
*Assistant Examiner*—Igor Kershteyn
(74) *Attorney, Agent, or Firm*—Richard A. Ryan

(57) ABSTRACT

A variable width pump impeller that allows for the selection of a fixed impeller width from two or more possible impeller widths. The impeller comprises a first impeller shroud having a plurality of impeller vanes and a second impeller shroud having an equal number of flat surfaces and one or more sets of grooves, each set comprising an equal number of recessed grooves for receiving the vanes of the first impeller shroud. The manufacturer selects between a flow channel formed by the outer edge of the vanes joining against the flat surfaces or one or more flow channel widths formed by vanes being received in the grooves. Once formed, the impeller has a fixed impeller width. Use of the impeller reduces the number of manufacturing molds required to make impellers of different widths and reduces the need to have an inventory of different impeller components.

16 Claims, 3 Drawing Sheets

VARIABLE WIDTH PUMP IMPELLER

BACKGROUND OF THE INVENTION

1. Field of the Invention

The present invention relates generally to radial flow impellers for use in centrifugal pumps and, more particularly, to an improved multiple-vane shrouded impeller that is constructed and arranged to allow the width between the impeller shrouds to be selected so as to obtain different optimum pump operating ranges for the same impeller components.

2. Background

As is well known in the art, impellers are utilized in centrifugal pumps to pressurize a flow of fluid. Standard impellers are typically of a fixed geometry which are designed and configured, along with the other pump components, for the pump to operate at peak efficiency at a specific pressure head and flow rate. The typical closed impeller has a pair of opposing shrouds or plates with a plurality of vanes or blades disposed between the opposing shrouds. The vanes are usually curved to facilitate radial discharge of the fluid, which enters the impeller at the center of the shroud. In the pump, the impeller is connected to a drive shaft mechanism that rotates the entire impeller assembly and is located in the pump casing. The volume of fluid that can flow through the impeller is fixed by the area defined by adjacent impeller vanes, the impeller wall and the opposing wall of the pump casing.

Currently, the typical process of making fabricated pump impellers is to utilize a front shroud that is substantially smooth across its inwardly facing surface and a back shroud that has a plurality of vanes protruding from its inwardly facing surface. The shrouds and vanes can be made by forming and welding, molding, injection molding, casting or die casting. During assembly of the impeller, the outer edge of the vanes are fixedly attached to the inwardly facing surface of the front shroud to form the flow channels between adjacent vanes. The vanes can be joined to the front shroud by fusion welding, brazing, sonic welding, friction or chemical adhesion. Once fixed, the impeller will put out a certain amount of flow for a given pump RPM and output head. Once the impeller is built, it is typically very difficult to change the operating characteristics because the width between the shrouds is fixed.

During the manufacturing process, the manufacturer typically makes a number of pump components that are suitable for selected pump sizes. For molded impellers, this requires a separate mold for each impeller width desired. As is well known in the art, molds are relatively expensive and have limited life. When the impeller components are put together, they are configured for a certain range of pump operating conditions. Because demand for certain size pumps can vary somewhat, the manufacturer must keep a significant inventory of impeller components on hand in order to meet anticipated and unanticipated needs for various size pumps. If the manufacturer anticipates incorrectly, it may find itself short of certain impeller components that are necessary to manufacture a specific size pump or be significantly overstocked on other impeller components that are configured for an unneeded size of pump. Either condition can create problems with meeting customer demands, increased costs to quickly manufacture needed parts and increased expenses from having an excessive inventory.

A number of patents provide pumps that are able to vary the flow characteristics by varying the width between the shrouds during the operation of the pump. Generally, they accomplish this by making at least one of the shrouds axially moveable relative to the other shroud. Such a pump is described in U.S. Pat. No. 4,417,849, which sets forth a pump having an impeller with two intermeshing impeller sections that are mounted on a common pump shaft such that one of the impeller sections is axially moveable relative to the other. The axial movement of the one impeller section, which is done in response to pump requirements, varies the width of the flow passage to decrease or increase the flow rate. A similar pump is described in U.S. Pat. No. 4,828,454, which discloses an impeller having an axially moveable shroud having a plurality of grooves for receiving the impeller vanes. The shroud moves to vary the flow passage width in response to system requirements. Another such pump is set forth in U.S. Pat. No. 5,211,530, which describes a two-piece impeller unit that includes an axially moveable shroud that has a plurality of radially extending grooves for receiving the impeller vanes in a meshing relationship and a plurality of axially extending grooves at its peripheral surface.

U.S. Pat. No. 2,358,744 discloses a centrifugal pump that varies the effective areas of the impeller blades on the two impeller sections. The pump capacity is varied by increasing or decreasing the overlap of the blades to increase or decrease the effective area of the impeller flow channel. U.S. Pat. No. 3,285,187 discloses an impeller for use in centrifugal pumps that utilizes rear and forward disks that both have blades thereon. When the two disks are joined together, the blades fill the space between the disks and form the flow channels therein. U.S. Pat. No. 3,918,831 discloses a variable impeller centrifugal pump having telescoping impeller sections. The driver impeller and the driven impeller operate together to form flow channels. The driver impeller is fixed to the pump drive shaft. An inducer varies the distance between the two driver and driven impellers to vary the pump characteristics. U.S. Pat. No. 4,412,783 discloses a centrifugal fan wheel having changeable pitch blades to control airflow independent of the speed of the fan.

Although the above described impellers and pumps, provide for variable flow rates during pumping operations, none of the above provide an impeller that can be fixedly set at various impeller widths during the manufacture of the pump that solves the problems associated with trying to anticipate customer needs for certain sized pumps. In addition, all of the above disclose relatively expensive pumps that are too costly for many types of very common pump uses, such as small circulating or centrifugal pumps utilized in home, business or industrial water circulation systems. Therefore, what is needed is an impeller that allows the manufacturer of the pump to fixedly select a desired impeller width from a single set of impeller components to substantially reduce pump component manufacturing, storage and inventory costs.

SUMMARY OF THE INVENTION

The variable width pump impeller of the present invention solves the problems identified above. That is to say, the present invention provides a pump impeller that can be configured into impellers of different fixed widths from the same impeller components so as to produce pumps having various operating characteristics. As such, the pump impeller of the present invention reduces the number of manufacturing molds that are needed to manufacture different impeller configurations and allows the manufacturer to substantially reduce its inventory of pump impeller components without risking having the components unavailable to meet demand for various sized pumps requiring different impeller widths.

In the primary embodiment of the present invention, the variable width pump impeller 10 is adapted to be rotationally mounted inside the housing of a centrifugal pump and is primarily comprised of a first impeller shroud having a first side and an opposite facing second side and a second impeller shroud also having a first side and an opposite facing second side. The second side of the first impeller shroud has a plurality of radially extending impeller vanes projecting axially therefrom. Each of the impeller vanes have an outer edge thereon. The first side of the second impeller shroud has a plurality of flat surfaces and a first set of grooves recessed therein. The plurality of axially recessed grooves that make up the first set of grooves are in alignment with the impeller vanes such that the vanes can be received by the grooves and be engaged therein in a meshing relationship. Once made, the impeller 10 can be configured by selectively joining the impeller vanes to either the flat surfaces or to the first set of grooves to form either a first flow channel (with the flat surfaces) or a second flow channel (with the first set of grooves) disposed between the second side of the first impeller shroud, the first side of the second impeller shroud and the impeller vanes for the passage of fluid to the pump outlet. The first flow channel will have a greater cross-sectional area than the second flow channel due to the greater effective impeller vane depth.

The typical pump impeller according to the present invention will also comprise an axial inlet in the second impeller shroud, a concavely frusto-conical surface leading into the axial inlet and a center hub in the first impeller shroud, the center hub being sized and configured to be at least partially disposed within the axial inlet when the first impeller shroud is joined to the second impeller shroud. For ease of joining the two impeller shrouds, one or more alignment pins on one or more of the impeller vanes and one or more corresponding alignment holes in one or more of the flat surfaces or the first recessed grooves can be utilized to ensure the two shroud pieces are properly aligned prior to fixedly joining them together.

In the preferred embodiment of the present invention, the first side of the second impeller shroud will have more than one set of grooves to allow the manufacturer to select the impeller depth that best matches the flow requirements of the pump utilizing impeller 10. For instance, the impeller 10 can have a second set of grooves, comprising a plurality of second recessed grooves, on the first side of second impeller shroud. Each of the second recessed grooves are axially recessed into the first side a second depth amount and angularly disposed along the first side of the second impeller shroud from one of the first recessed grooves. When the vanes are disposed in the second recessed grooves, the second side of the first impeller shroud, the first side of the second impeller shroud and the impeller vanes form a third flow channel for the passage of fluid therein. If the first depth amount is less than the second depth amount, the second flow channel will have a greater cross-sectional area than that of the third flow channel due to the greater effective vane depth.

Accordingly, the primary objective of the present invention is to provide a variable width pump impeller that is suitable for allowing the manufacturer to selectively choose between two or more fixed impeller widths from the same impeller components.

It is also an important objective of the present invention to provide a variable width pump impeller that has a plurality of vanes that can engage an equal number of flat surfaces or recessed grooves to provide flow channels of different vane depths.

It is also an important objective of the present invention to provide a variable width pump impeller that allows a manufacturer to reduce the number of molds necessary to manufacture impeller shrouds and to reduce the inventory of such impeller shrouds by providing an impeller that is suitable for selecting from a preset number of vane depths to obtain a fixed impeller width.

It is also an important objective of the present invention to provide a variable width pump impeller that has two or more fixed impeller vane depths and which can be made out of a variety of materials to obtain an impeller of fixed width.

The above and other objectives of the present invention will be explained in greater detail by reference to the figures and the description of the preferred embodiment which follows. As set forth herein, the present invention resides in the novel features of form, construction, mode of operation and combination of parts presently described and understood by the claims.

BRIEF DESCRIPTION OF THE DRAWINGS

In the drawings which illustrate the best modes presently contemplated for carrying out the present invention.

DETAILED DESCRIPTION OF THE PREFERRED EMBODIMENTS

Figure 1:
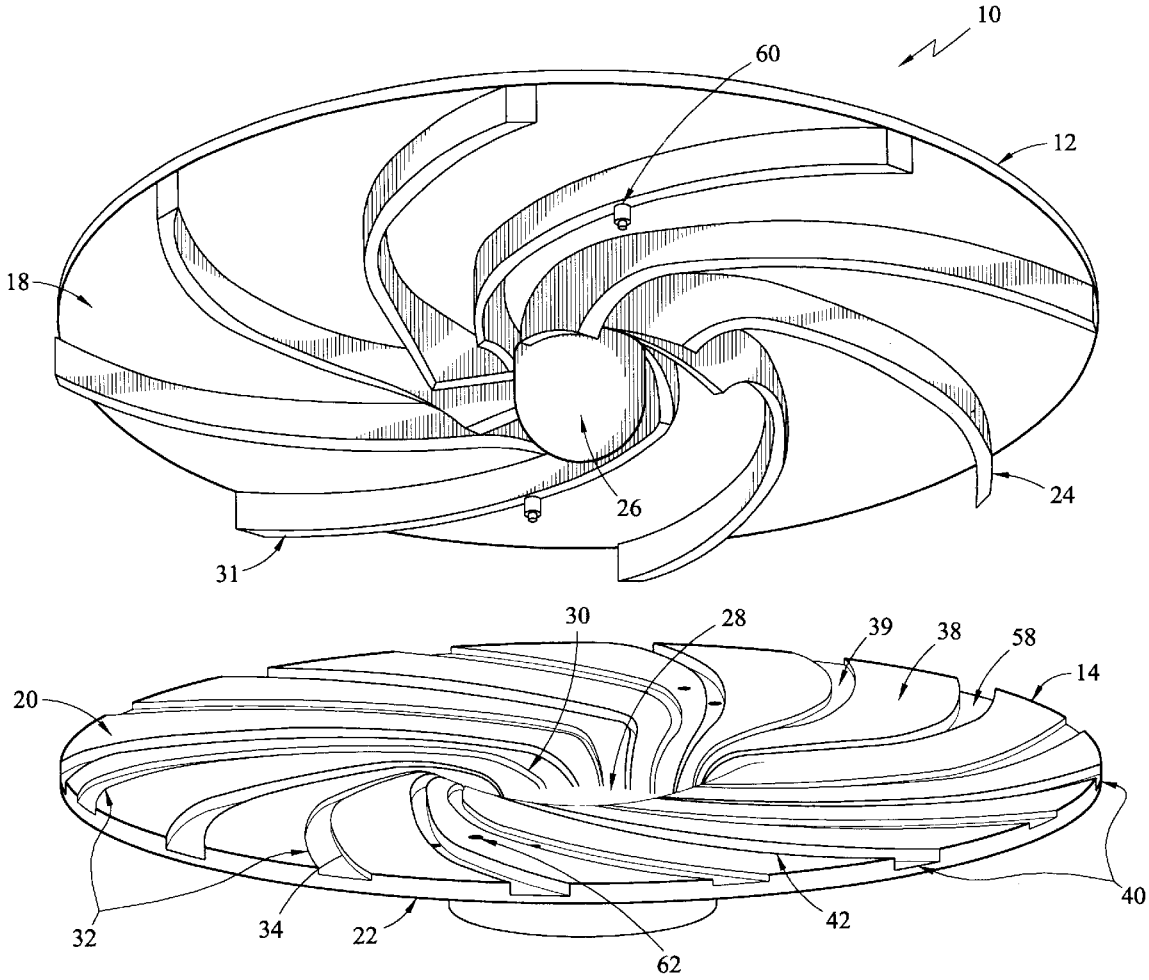
FIG. 1 is a perspective view of an exploded pump impeller of the present invention.

With reference to the figures where like elements have been given like numerical designations to facilitate the reader's understanding of the present invention, and particularly with reference to the embodiment of the present invention illustrated in FIGS. 1 through 5, the preferred embodiment of the circulating or centrifugal pump impeller of the present invention is designated generally as 10. As is well known in the art, pump impellers are mounted inside pump casings to impart a centrifugal force, from the rotation of the pump impeller, to the pump intake fluid so that it may be discharged out the pump at a greater head. Pump impeller 10 is configured to be rotationally mounted inside the pump housing and generally comprises a first impeller shroud 12 and a second impeller shroud 14. First impeller shroud 12 has a first side 16 and an opposite facing second side 18. In the referenced figures, first side 16 of first impeller shroud 12 is shown upwardly facing and second side 18 of first impeller shroud 12 is downwardly facing. Likewise, second impeller shroud 14 has a first side 20 and an opposite facing second side 22. In the figures, first side 20 of second impeller shroud 14 is shown upwardly facing and second side 22 is downwardly facing. The first 12 and second 14 impeller shrouds are spatially aligned such that the second side 18 of first impeller shroud 12 is positioned above the first side 20 of second impeller shroud. In operation, first 12 and second 14 impeller shrouds are joined together to form a single impeller unit, as set forth in more detail below.

Figure 3:
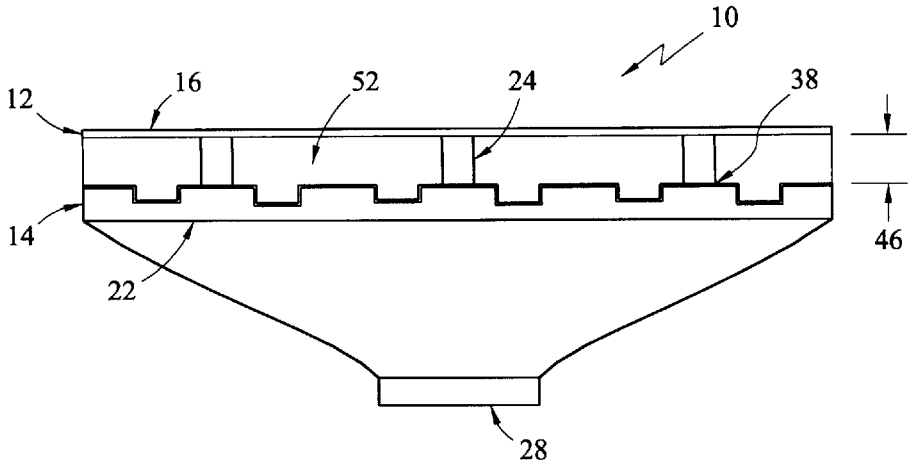
FIG. 3 is a side view of a pump impeller of the present invention showing a second vane width.
Figure 4:
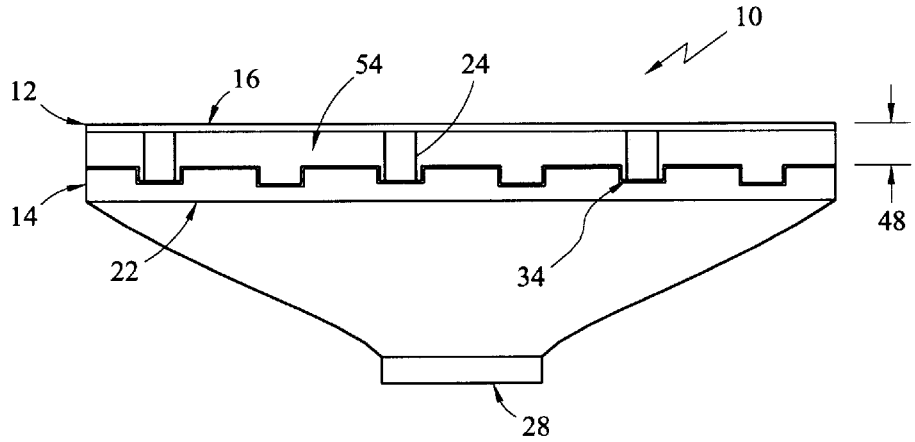
FIG. 4 is a side view of a pump impeller of the present invention showing a third vane width.
Figure 5:
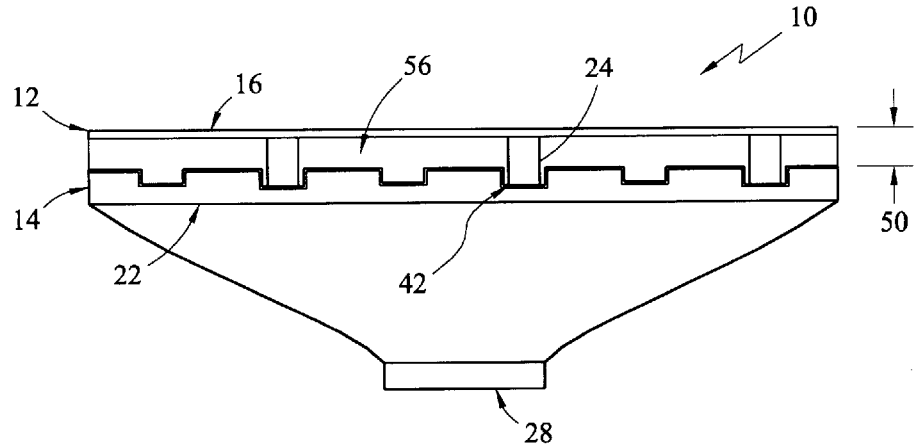
FIG. 5 is a side view of the edges of the first and second impeller shrouds showing the different groove depths.
Figure 6:
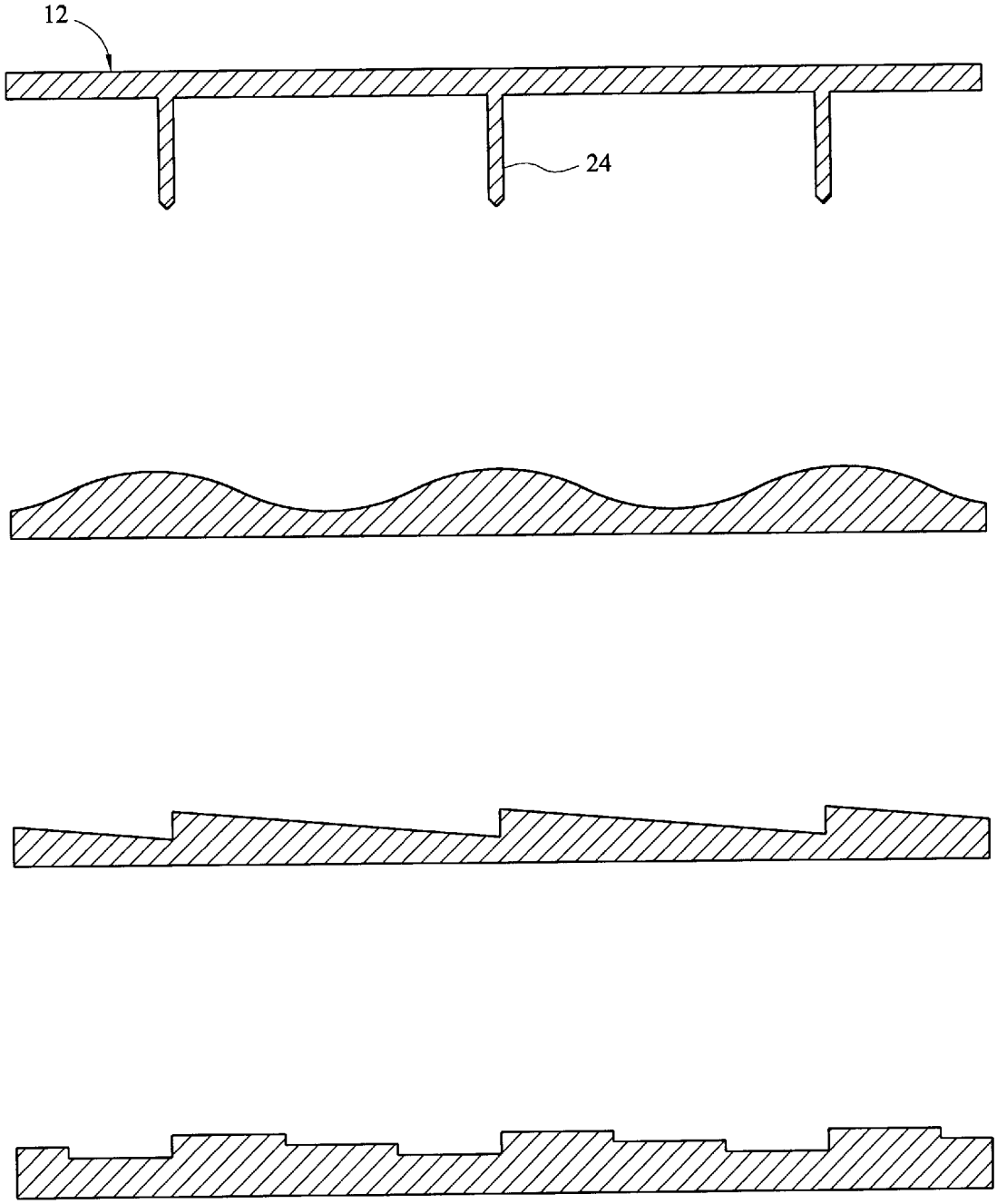
FIG. 6 illustrates various alternative embodiments for the configuration of the second impeller shroud.

First 12 and second 14 impeller shrouds, as well as the remaining components of impeller 10, can be made out of any of a variety of materials, such as plastics, metals and composites, that are suitable for the intended use of the pump in which the impeller 10 will be installed. These materials are generally selected on their ability to be molded into the desired configuration, how well they interconnect and interact with the other materials and their ability to function in the fluid, pressure and other operating conditions in which the pump is designed. One common material for the impeller shrouds 12 and 14 is plastic or plastic-type materials, such as Noryl® (from GE Plastics), that are suitable for injection molding. These parts are often fixedly joined together by sonic or friction welding or through the use of adhesives. Once joined together, first 12 and second 14 impeller shrouds form an integral unit, as shown in FIGS. 3 through 5. For a given pump speed (RPM) and output head, the impeller 10 will discharge a certain amount of flow. Because the impeller vane height, the effective distance between the second side 18 of the first impeller shroud 12 and the first side 20 of the second impeller shroud 14, is fixed, it is generally not possible to alter the configuration of impeller 10 after it is manufactured as an integral unit.

On the second side 18 of the first impeller shroud 12 is located a plurality of radially extending impeller vanes 24 that project axially from the second side 18 of shroud 12 and a center hub 26 located at the center of second side 18. FIG. 1 illustrates the use of an eight-vane impeller 10. Impellers can have more or less vanes 24 depending on the anticipated use and sizing of the subject pump. Depending on the configuration and materials for first impeller shroud 12, vanes 24 can be made to be integral with the second side 18 of first impeller shroud 12 or the vanes 24 can be made separately and then fixedly attached to second side 18. As is known in the art, and shown in FIG. 1, vanes 24 can be curved so as to better obtain the fluid movement action described below.

Figure 2:
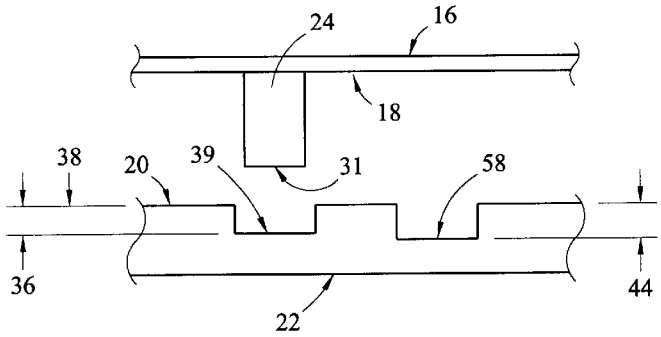
FIG. 2 is a side view of a pump impeller of the present invention showing a first vane width.

Second impeller shroud 14 has an axial inlet 28 for the flow of fluid from the pump inlet to inside impeller 10. In the preferred embodiment, second impeller shroud 14 has a concavely frusto-conical surface 30 leading from axial inlet 28 to the interior of the single piece impeller 10. The heretofore typical second impeller shroud 14 component is manufactured with a relatively smooth, flat surface against which the outer edge 31 of vanes 24 make contact when first impeller shroud 12 and second impeller shroud 14 are joined. With regard to the present invention 10, however, the first side 20 of second impeller shroud 14 has at least one set of grooves, such as first set of grooves 32 comprising a plurality of first recessed grooves 34 recessed into said first side 20 of second impeller shroud 14. First set of grooves 32 is in functional alignment, meaning of the same shape, size and configuration (i.e., angular spacing) or enough the same for vanes 24 to fit within grooves 32, with the plurality of vanes 24 so that the plurality of vanes 24 will fit within grooves 34 in a meshing relationship. For instance, if eight vanes 24 are utilized, as shown, then first set of grooves 32 and every other set of recessed grooves utilized must have eight grooves. Each of the grooves 34 in the first set of grooves 32 is disposed axially into second impeller shroud 14 a first depth amount 36, as measured from what would have been the smooth non-grooved, flat surface 38 (also referred to as the zero depth level) of first side 20 in a plane substantially orthogonal to the axis of rotation of second impeller shroud 14. The relationship between flat surface 38 and first depth amount 36 is best shown in FIG. 2, which is a magnified, partial side view of second impeller shroud 14 showing various groove depths.

With a single set of grooves 32, as described above, impeller 10 of the present invention has two possible impeller depths, allowing the maker of the impeller 10 to select which impeller depth is most appropriate for the pump operation desired. The greatest impeller depth results from the placement of vanes 24 against the non-grooved, zero depth flat surface 38. A shallower impeller depth, which provides a reduced cross-sectional flow area for impeller 10, results from placing vanes 24 inside the first set of grooves 32 instead of at the zero depth level 38. When the shrouds 12 and 14 are joined, the vanes 24 fit within grooves 32 and the outer edge 31 of vanes 24 abuts the bottom surfaces 39 of grooves 32 in a meshing relationship. Although a number of multiple groove sets can be utilized, limited only by the space available on first side 20 of second impeller shroud 14, the impeller 10 shown in FIG. 1 only has a second set of grooves 40. Second set of grooves 40 comprises a plurality of second recessed grooves 42, each of which is disposed axially into second impeller shroud 14 a second depth amount 44, also as measured from the zero depth level 38 of first side 20 in a plane substantially orthogonal to the axis of rotation of second impeller shroud 14 (as best shown in FIG. 2). The use of a second set of grooves 40 provides the impeller with three possible vane depths: (1) a first vane depth 46 resulting from placement of vanes 24 against the zero depth level 38 of first side 20; (2) a second vane depth 48 resulting from placement of vanes 24 into first recessed grooves 34, which are axially disposed into first surface 20 a first depth amount 36; and (3) a third vane depth 50 resulting from placement of vanes 24 into second recessed grooves 42, which are axially disposed into first surface 20 a second depth amount 44, as shown in FIGS. 3, 4 and 5, respectively. In this manner, the manufacturer of the impeller 10 of the present invention has three choices of vane depths from a single set of impeller components, which can substantially reduce costs for molds and significantly lower inventory needs.

To manufacture a completed impeller 10 according to the present invention, first impeller shroud 12 is joined to second impeller shroud 14 by aligning the plurality of vanes 24 with either the zero depth level 38, first set of grooves 32 or second set of grooves 40. When the first 12 and second 14 impeller shrouds are fixedly joined together a plurality of flow channels are created. The first flow channel 52, shown in FIG. 3, results from the placement of vanes 24 against the zero depth level 38. First flow channel 52 is the channel with the greatest cross-sectional area and, as a result, will provide the greatest flow rate at the same RPM and head. The second flow channel 54, shown in FIG. 4, results from the placement of vanes 24 in a meshing relationship against the bottom surface 39 of first set of grooves 32. Second flow channel 54 will result in less flow and less required power demand than first flow channel 52 due to the reduced cross-sectional area. Third flow channel 56, shown in FIG. 5, results from the placement of vanes 24 against the bottom surface 58 of second set of grooves 40. Third flow channel 56 will result in less flow rate than first flow channel 52 and second flow channel 54 due to the further decrease in cross-sectional area. To assist in joining the first impeller shroud 12 to the second impeller shroud 14, one or more alignment pins 60 can be placed on the outer edge 31 of one or more vanes 24 and one or more corresponding alignment holes 62 can be located on the flat surface 38, at the bottom surface 39 of first grooves 34 or at the bottom surface 58 of second grooves 42. The alignment pins 60 should be sized and configured to fit tightly within alignment holes 62 so that the vanes 24 will be properly aligned with either the flat surfaces 38, first grooves 34 or second grooves 42, depending on the size of flow channels desired.

For purposes of illustrating the variable width pump impeller of the present invention, an example configuration is set forth. The following configuration is just one that is representative of the many configurations possible for an impeller made pursuant to the present invention. The example configuration is for illustrative purposes only and is not intended to restrict the invention to a particular configuration used in the example. In the example configuration, first impeller shroud 12 has a diameter of 100 mm and second impeller shroud 14 has a diameter of 100 mm. Eight impeller vanes 24 radiate axially from the center hub 26, where it abuts second side 18 of first impeller shroud 12. First side 20 of second impeller shroud 14 has a flat surface 38 and a first set of grooves 32 and a second set of grooves 40 spaced laterally from each other. The first depth amount 36 for grooves 34 is 2 mm and the second depth amount 44 for grooves 42 is 4 mm, as measured downward from the plane formed by flat surface 38. When first 12 and second impeller shrouds are joined together, the alternate flow channel depths are 8 mm for first flow channel 52 (which is approximately equal to the amount vanes 24 extend radially outward from second side 18 of first impeller shroud 12), 6 mm for second flow channel 54 formed by vanes 24 received in the grooves 34 of the first set of grooves 32, and 4 mm for third flow channel 56 formed by vanes 24 received in the grooves 42 of the second set of grooves 40.

In use the pump and/or impeller manufacturer makes a mold for an impeller where the first impeller shroud 12 has a plurality of vanes 24 extending from the second side thereof and where the second impeller shroud 14 has at least one set of grooves cut into the first side thereof for receiving vanes 24 inside the grooves. As described herein, one such configuration is to utilize two sets of grooves, a first set of grooves 32 and a second set of grooves 40 where the grooves 34 in the first set 32 are recessed into first side 20 a lesser amount 36 than the amount 44 which grooves 42 of the second set 40 are recessed into first side 20 of second impeller shroud 14.

While there is shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape, and use.

What is claimed is:

1. A variable width pump impeller adapted to be rotationally mounted in a centrifugal pump, comprising:

a first impeller shroud having a first side and an opposite facing second side;

a plurality of radially extending impeller vanes projecting axially from said second side of said first impeller shroud, said impeller vanes having an outer edge thereon;

a second impeller shroud having a first side and an opposite facing second side, said first side of said second impeller shroud having a plurality of flat surfaces thereon; and a first set of grooves on said first side of said second impeller shroud in alignment with said impeller vanes, said first set of grooves comprising a plurality of first recessed grooves, each of said first recessed grooves recessed axially in said first side a first depth amount and configured to engage said vanes in a meshing relationship, whereby said impeller vanes on said second side of said first impeller shroud are selectively joined to either said flat surfaces or said first set of grooves on said first side of said second impeller shroud to form either a first flow channel or a second flow channel disposed between said second side of said first impeller shroud, said first side of said second impeller shroud and said impeller vanes for the passage of fluid therein.

2. The pump impeller according to claim 1 further comprising an axial inlet in said second impeller shroud and a concavely frusto-conical surface leading into said axial inlet.

3. The pump impeller according to claim 2 further comprising a center hub in said first impeller shroud, said center hub sized and configured to be at least partially disposed within said axial inlet when said first impeller shroud is joined to said second impeller shroud.

4. The pump impeller according to claim 1 further comprising a second set of grooves on said first side of second impeller shroud in alignment with said impeller vanes, said second set of grooves comprising a plurality of second recessed grooves, each of said second recessed grooves axially recessed into said first side a second depth amount and laterally disposed along said first side of said second impeller shroud from one of said first recessed grooves, said second side of said first impeller shroud, said first side of said second impeller shroud and said impeller vanes forming a third flow channel for the passage of fluid therein when said vanes are disposed in said second recessed grooves.

5. The pump impeller according to claim 4, wherein said first depth amount is less than said second depth amount.

6. The pump impeller according to claim 1 further comprising one or more alignment pins on one or more of said impeller vanes and one or more corresponding alignment holes in one or more of said flat surfaces and first recessed grooves.

7. A variable width pump impeller adapted to be rotationally mounted in a centrifugal pump, comprising:

a first impeller shroud having a first side and an opposite facing second side;

a plurality of radially extending impeller vanes projecting axially from said second side of said first impeller shroud, said impeller vanes having an outer edge thereon;

a second impeller shroud having a first side and an opposite facing second side, said first side of said second impeller shroud having a plurality of flat surfaces thereon, said second side of said first impeller shroud, said vanes and said first side of said second impeller shroud forming a first flow channel therein when said impeller is configured so said outer edge of said vanes abut said flat surfaces to join said second side of said first impeller shroud to said second side of said first impeller shroud; and a first set of grooves on said first side of second impeller shroud in alignment with said impeller vanes, said first set of grooves comprising a plurality of first recessed grooves, each of said first recessed grooves recessed axially in said first side a first depth amount, said second side of said first impeller shroud, said vanes and said first side of said second impeller shroud forming a second flow channel therein when said impeller is configured so said impeller vanes are disposed in a meshing relationship with said first recessed grooves to join said second side of said first impeller shroud to said second side of said first impeller shroud.

8. The pump impeller according to claim 7 further comprising an axial inlet in said second impeller shroud and a concavely frusto-conical surface leading into said axial inlet.

9. The pump impeller according to claim 8 further comprising a center hub in said first impeller shroud, said center hub sized and configured to be at least partially disposed within said axial inlet when said first impeller shroud is joined to said second impeller shroud.

10. The pump impeller according to claim 7 further comprising a second set of grooves on said first side of second impeller shroud in alignment with said impeller vanes, said second set of grooves comprising a plurality of second recessed grooves, each of said second recessed grooves axially recessed into said first side a second depth amount and laterally disposed along said first side of said second impeller shroud from one of said first recessed grooves, said second side of said first impeller shroud, said first side of said second impeller shroud and said impeller vanes forming a third flow channel for the passage of fluid therein when said vanes are disposed in said second recessed grooves.

11. The pump impeller according to claim 10, wherein said first depth amount is less than said second depth amount.

12. The pump impeller according to claim 7 further comprising one or more alignment pins on one or more of said impeller vanes and one or more corresponding alignment holes in one or more of said flat surfaces and first recessed grooves.

13. A variable width pump impeller adapted to be rotationally mounted in a centrifugal pump, comprising:

a first impeller shroud having a first side and an opposite facing second side;

a plurality of radially extending impeller vanes projecting axially from said second side of said first impeller shroud, said impeller vanes having an outer edge thereon;

a second impeller shroud having a first side and an opposite facing second side, said first side of said second impeller shroud having a plurality of flat surfaces thereon, said second side of said first impeller shroud, said vanes and said first side of said second impeller shroud forming a first flow channel therein when said impeller is configured so said outer edge of said vanes abut said flat surfaces to join said second side of said first impeller shroud to said second side of said first impeller shroud;

a first set of grooves on said first side of said second impeller shroud in alignment with said impeller vanes, said first set of grooves comprising a plurality of first recessed grooves, each of said first recessed grooves recessed axially in said first side a first depth amount, said second side of said first impeller shroud, said vanes and said first side of said second impeller shroud forming a second flow channel therein when said impeller is configured so said impeller vanes are disposed in a meshing relationship with said first recessed grooves to join said second side of said first impeller shroud to said second side of said first impeller shroud; and a second set of grooves on said first side of second impeller shroud in alignment with said impeller vanes, said second set of grooves comprising a plurality of second recessed grooves, each of said second recessed grooves axially recessed in said first side a second depth amount and laterally disposed along said first side of said second impeller shroud from one of said first recessed grooves, said first depth amount less than said second depth amount, said second side of said first impeller shroud, said first side of said second impeller shroud and said impeller vanes forming a third flow channel for the passage of fluid therein when said vanes are disposed in said second recessed grooves.

14. The pump impeller according to claim 13 further comprising an axial inlet in said second impeller shroud and a concavely frusto-conical surface leading into said axial inlet.

15. The pump impeller according to claim 14 further comprising a center hub in said first impeller shroud, said center hub sized and configured to be at least partially disposed within said axial inlet when said first impeller shroud is joined to said second impeller shroud.

16. The pump impeller according to claim 13 further comprising one or more alignment pins on one or more of said impeller vanes and one or more corresponding alignment holes in one or more of said first recessed grooves and said second recessed grooves.

* * * * *